US008737870B2

(12) United States Patent
Mori

(10) Patent No.: US 8,737,870 B2
(45) Date of Patent: May 27, 2014

(54) IMAGE-FORMING APPARATUS

(75) Inventor: Hirotaka Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 146 days.

(21) Appl. No.: 13/355,385

(22) Filed: Jan. 20, 2012

(65) Prior Publication Data

US 2012/0251164 A1 Oct. 4, 2012

(30) Foreign Application Priority Data

Mar. 30, 2011 (JP) ..... 2011-074672

(51) Int. Cl.
*G03G 15/00* (2006.01)
*G03G 21/18* (2006.01)

(52) U.S. Cl.
USPC ..... 399/110; 399/111

(58) Field of Classification Search
USPC ..... 399/110, 111
See application file for complete search history.

(56) References Cited

U.S. PATENT DOCUMENTS

| | | | | |
|---|---|---|---|---|
| 5,930,561 | A | 7/1999 | Hosokawa et al. | |
| 6,735,406 | B1 | 5/2004 | Noda | |
| 2006/0222402 | A1 | 10/2006 | Sato et al. | |
| 2009/0190953 | A1* | 7/2009 | Okabe | 399/111 |
| 2010/0080615 | A1* | 4/2010 | Kikuchi | 399/111 |

FOREIGN PATENT DOCUMENTS

| | | | |
|---|---|---|---|
| JP | H08-305243 | A | 11/1996 |
| JP | H10-333530 | A | 12/1998 |
| JP | 2001-175147 | A | 6/2001 |
| JP | 2006-276776 | A | 10/2006 |
| JP | 2007-065125 | A | 3/2007 |
| JP | 2009-042793 | A | 2/2009 |

OTHER PUBLICATIONS

Japan Patent Office, Office Action for Japanese Patent Application No. 2011-074672 (counterpart Japanese patent application), mailed Mar. 5, 2013.

* cited by examiner

*Primary Examiner* — Clayton E Laballe
*Assistant Examiner* — Jas Sanghera
(74) *Attorney, Agent, or Firm* — Merchant & Gould P.C.

(57) ABSTRACT

An image-forming apparatus includes: a process cartridge including a photosensitive drum having a photosensitive surface and a rotational axis; an exposing unit having a first end, a second end opposing the first end, and an exposing surface formed on the first end and oriented in a predetermined direction; and a supporting member on which the process cartridge is mountable from a side of the second end. The supporting member has a pivotal supporting portion configured to pivotably movably support the process cartridge between an exposing position where the photosensitive surface of the photosensitive drum faces the exposing surface and a retracted position where the photosensitive surface of the photosensitive drum is offset from the exposing surface, the exposing surface being configured to expose the photosensitive surface of the photosensitive drum to form an electrostatic latent image when the process cartridge is positioned at the exposing position.

13 Claims, 8 Drawing Sheets

IMAGE-FORMING APPARATUS

CROSS REFERENCE TO RELATED APPLICATION

This application claims priority from Japanese Patent Application No. 2011-074672 filed Mar. 30, 2011. The entire content of the priority application is incorporated herein by reference.

TECHNICAL FIELD

The present invention relates to an image-forming apparatus on which a process cartridge is mountable.

BACKGROUND

A well-known image-forming apparatus includes a casing whose upper portion is formed with an opening, a top cover configured to open and close the opening and an LED head supported by the top cover and having an exposing surface facing downward. When the top cover is closed to mount a process cartridge including a photosensitive drum in the casing, the exposing surface of the LED head opposes the photosensitive drum to expose the photosensitive drum. Further, the LED head is retracted from the process cartridge when the top cover is opened, thereby enabling the process cartridge to be replaced easily.

SUMMARY

A construction that supports the LED head by the casing instead of the top cover is conceivable. However, in this construction, the process cartridge should be inserted deep into a position below the exposing surface of the LED head from above (from a side opposite to the exposing surface). Conceivably, mounting of this process cartridge may involve difficulty.

In view of the foregoing, it is an object of the present invention to provide an image-forming apparatus capable of easily mounting a process cartridge from a side opposite to an exposing surface of an LED head supported by a casing.

In order to achieve the above and other objects, there is provided an image-forming apparatus including: a process cartridge including a photosensitive drum having a photosensitive surface and a rotational axis; an exposing unit having a first end, a second end opposing the first end, and an exposing surface formed on the first end and oriented in a predetermined direction; and a supporting member on which the process cartridge is mountable from a side of the second end. The supporting member has a pivotal supporting portion configured to pivotably movably support the process cartridge between an exposing position where the photosensitive surface of the photosensitive drum faces the exposing surface and a retracted position where the photosensitive surface of the photosensitive drum is offset from the exposing surface, the exposing surface being configured to expose the photosensitive surface of the photosensitive drum to form an electrostatic latent image when the process cartridge is positioned at the exposing position.

DETAILED DESCRIPTION

<General Configuration of Color Laser Printer 1>

First, a general configuration of a color printer 1 as an example of an image-forming apparatus according to an embodiment of the present invention will be described with reference to FIGS. 1 and 2.

In the following description, a left side in FIG. 1 will be referred to as a front side, while a right side in FIG. 1 will be referred to as a rear side. The terms "upward", "downward", "upper", "lower", "above", "below", "beneath", "right", "left", "front", "rear" and the like will be used assuming that the color printer 1 is viewed from its front side. That is, a near side in FIG. 1 will be referenced as a right side, while a far side in FIG. 1 will be referenced as a left side.

Figure 1:
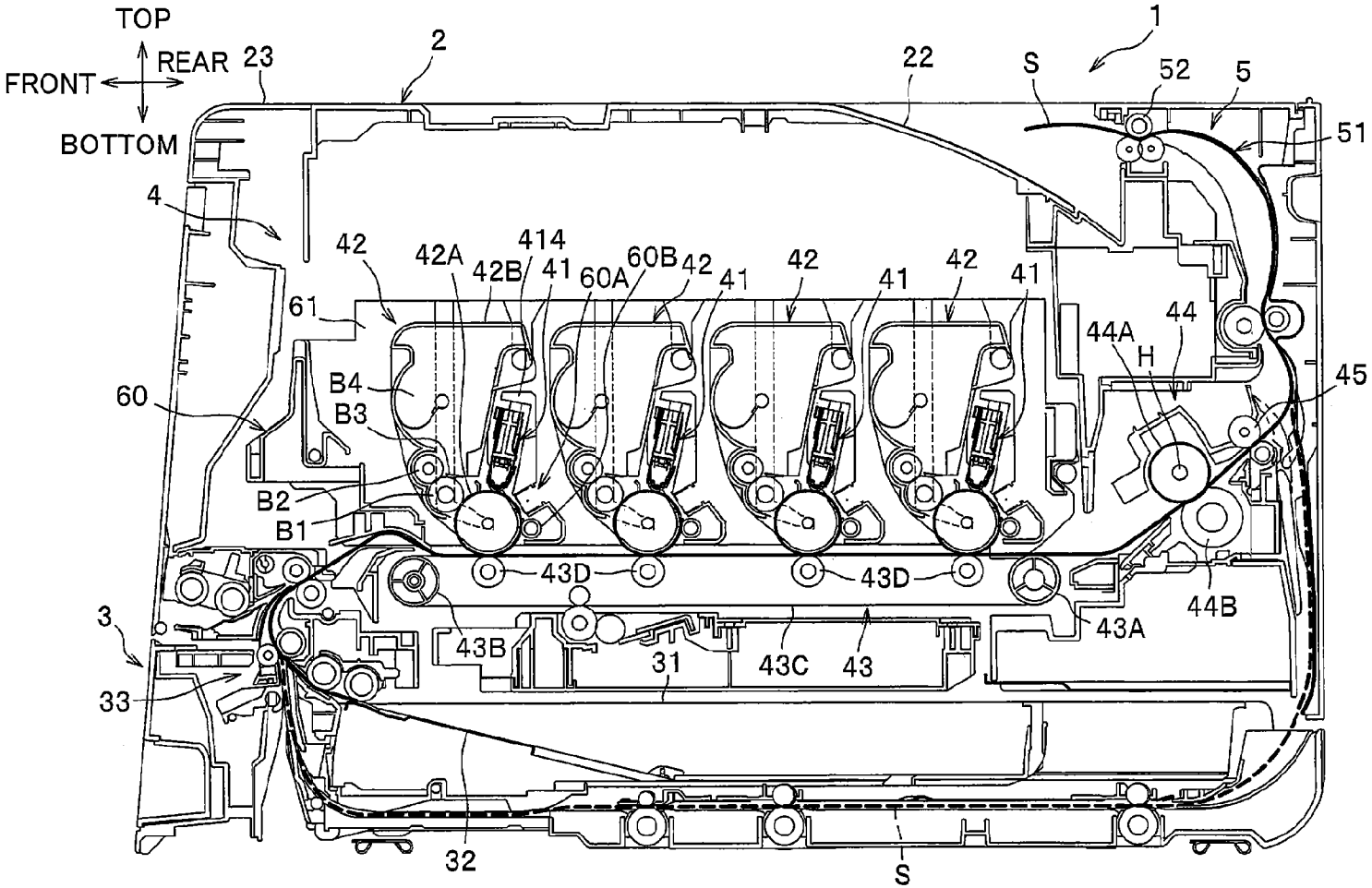
FIG. 1 is a view showing an internal construction of a color printer according to an embodiment of the present invention, the color printer incorporating a drawer in which a plurality of process cartridges is mounted.

As shown in FIG. 1, the color printer 1 includes a main body 2 within which a sheet feeding unit 3, an image forming unit 4 and a sheet discharging unit 5 are disposed.

The main body 2 is formed in a box shape having a substantially rectangular shape in a side view. A front cover 23 is pivotably movably provided at a lower portion of the front side of the main body 2. When the front cover 23 is opened, an opening 24 formed on the front side of the main body 2 is exposed to outside (see FIG. 3).

The sheet feeding unit 3 is arranged at a lower portion of the main body 2. The sheet feeding unit 3 includes a sheet tray 31 for accommodating sheets S therein, a lifter plate 32, and a sheet conveying mechanism 33. The sheet S accommodated within the sheet tray 31 is lifted upward by the lifter plate 32, and is conveyed to the image forming unit 4 by the sheet conveying mechanism 33. As shown by a thick solid line in FIG. 1, the sheet S stacked in the sheet tray 31 is first conveyed frontward and then makes a U-turn to be conveyed rearward.

The image forming unit 4 includes four LED units 41 as an example of an exposing unit, four process cartridges 42 each corresponding to each LED unit 41, a transfer unit 43, and a fixing unit 44.

The four LED units 41 are supported to a drawer 60 (described later).

Figure 2:
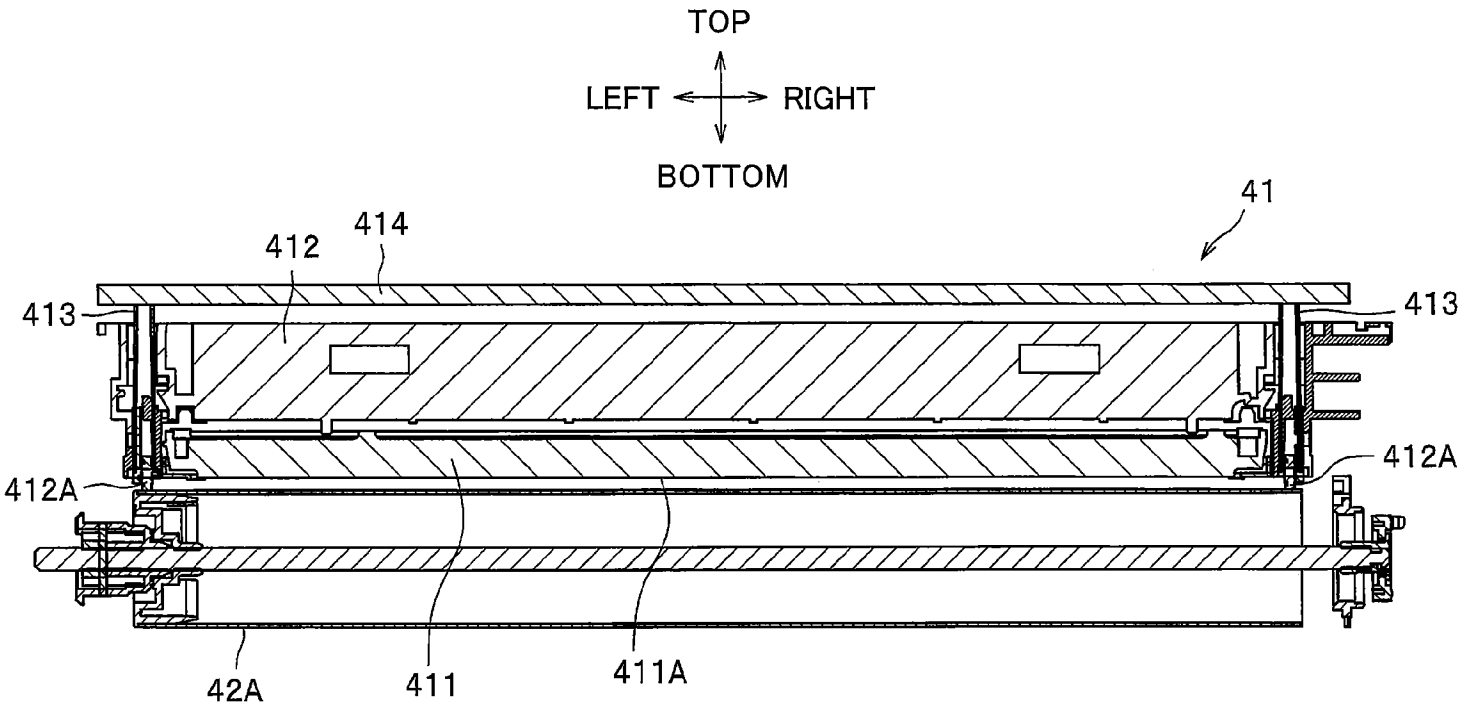
FIG. 2 is a cross-sectional view showing an LED unit provided on the drawer and a photosensitive drum of the process cartridge.

As shown in FIG. 2, each LED unit 41 includes an LED head 411, a supporting frame 412 that supports the LED head 411, a coil spring 413, and a base portion 414 supporting the supporting frame 412 via the coil spring 413. The LED head 411 is configured of a plurality of LEDs and has an exposing surface 411A configured to face a photosensitive surface of a photosensitive drum 42A when the process cartridge is mounted on the drawer 60.

More specifically, as shown in FIG. 1, the supporting frame 412 has a substantially rectangular shape in a side view whose length in the front-to-rear direction is smaller than that in a top-to-bottom direction (vertical direction). Further, the length of the supporting frame 412 in the front-to-rear direction is also smaller than that in the left-to-right direction, as shown in FIGS. 1 and 2. Each of the base portion 414 and the LED head 411 also has an elongated shape extending in the left-to-right direction.

As shown in FIG. 2, a guide roller 412A is rotatably provided on each end of the supporting frame 412 in the left-to-right direction. Each guide roller 412A is biased toward the photosensitive surface of the photosensitive drum 42A by the coil spring 413 so as to contact with the corresponding photosensitive drum 42A, when the process cartridge 42 is mounted on the drawer 60. Due to the contact of the guide roller 412A with the photosensitive drum 42A, the exposing surface 411A of the LED head 411 can stay away from the photosensitive surface of the photosensitive drum 42A by a prescribed distance.

The four process cartridges 42 are detachably mounted on the drawer 60 and juxtaposed therein in the front-to-rear direction. Each process cartridge 42 includes the photosensitive drum 42A and a developing unit 42B configured to supply developer (toner in the present embodiment) to the photosensitive drum 42A, as shown in FIG. 1.

The developing unit 42B includes a developing roller B1, a supply roller B2, a thickness-regulation blade B3, and a toner accommodating section B4. Each process cartridge 42 stores toner of a different color, but has a construction substantially identical to one another.

Figure 3:
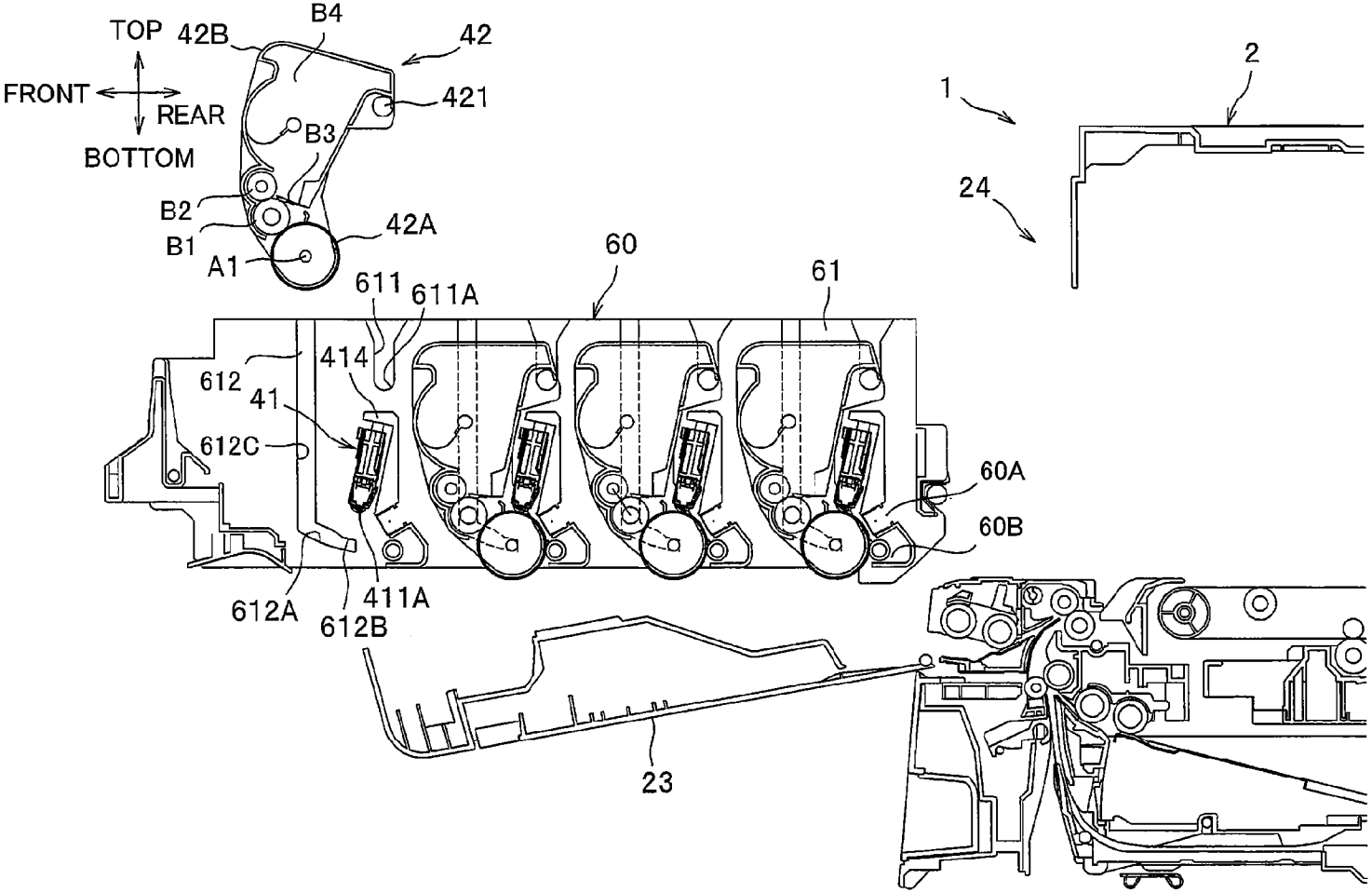
FIG. 3 is a view showing a state where the drawer is taken out of the color printer of FIG. 1, the process cartridge having a pivot shaft.

More specifically, as shown in FIGS. 1 and 3, when the process cartridge 42 is mounted on the drawer 60, the toner accommodating section B4 is positioned diagonally frontward and upward of the corresponding LED unit 41. The supply roller B2 is positioned below the toner accommodating section B4. The developing roller B1 is positioned downward and rearward of the supply roller B2, and the photosensitive drum 42A is positioned downward and rearward of the developing roller B1. The photosensitive drum 42A has a rotational shaft A1 about which the photosensitive drum 42A is rotatable.

The process cartridge 42 has a front surface curving rearward in conformance with outer profiles of the toner accommodating section B4, the supply roller B2, the developing roller B1 and the photosensitive drum 42A. More specifically, as shown FIG. 3, the front surface of the process cartridge 42 has a curvature gradually becoming greater as extending downward.

As shown in FIG. 1, the drawer 60 on which the process cartridges 42 are mountable includes four chargers 60A and four cleaning rollers 60B as an example of a cleaning member, in correspondence with the four process cartridges 42. The charger 60A is configured to charge the photosensitive drum 42A. The cleaning roller 60B is configured to be in contact with the photosensitive drum 42A for removing foreign matters (toner, paper dusts, and so on) therefrom.

More specifically, the charger 60A and the cleaning roller 60B are disposed rearward of the corresponding photosensitive drum 42A, while the developing roller B1 and the supply roller B2 are disposed frontward of the photosensitive drum 42A. In other words, with respect to a rotational direction (a counterclockwise direction in FIG. 1) of the photosensitive drum 42A, the cleaning roller 60B, the charger 60A and the LED unit 41 are arranged upstream to downstream in the rotational direction.

The transfer unit 43 is disposed above the sheet tray 31 and below the mounted process cartridges 42, as shown in FIG. 1. The transfer unit 43 includes a drive roller 43A, a follower roller 43B, an endless belt 43C mounted on the drive roller 43A and the follower roller 43B in a taut state, and four transfer rollers 43D. The endless belt 43C has an outer circumferential surface with which each photosensitive drum 42A is in contact. The four transfer rollers 43D are disposed within an internal space formed by the endless belt 43C such that the endless belt 43C is nipped between each transfer roller 43D and its corresponding photosensitive drum 42A.

The fixing unit 44 is disposed reward of the mounted process cartridges 42. The fixing unit 44 includes a cylindrical-shaped heat roller 44A, a pressure roller 44B and a heater H. The pressure roller 44B is disposed in opposition to the heat roller 44A for applying pressure to the same and the heater H is disposed within the heat roller 44A for heating the same.

With the construction described above, the photosensitive surface of the photosensitive drum 42A is charged by the charger 60A, and then exposed to light by the LED unit 41 in accordance with print data. An electrostatic latent image is thus formed on the photosensitive surface of the photosensitive drum 42A. In the meantime, toner within the toner accommodating section B4 is supplied to the developing roller B1 via the supply roller B2, enters between the developing roller B1 and the thickness-regulation blade B3, and is carried on the developing roller B1 as a thin layer of uniform thickness.

As the photosensitive drum 42A rotates in the counterclockwise direction in FIG. 1, the toner borne on the developing roller B1 is supplied to the electrostatic latent image formed on the photosensitive surface of the photosensitive drum 42A, thereby developing the electrostatic latent image into a visible toner image. The toner image formed on the photosensitive surface of each photosensitive drum 42A is then sequentially superimposed and transferred onto the sheet S, as the sheet S supplied from the sheet feeding unit 3 passes between each photosensitive drum 42A and the endless belt 43C (corresponding transfer roller 43D).

The sheet S on which the toner image is transferred is then conveyed to the fixing unit 44. As the sheet S passes between the heat roller 44A and the pressure roller 44B, the toner image transferred on the sheet S is thermally fixed thereon. In this way, images can be formed on the sheet S.

The image-formed sheet S is then conveyed to the sheet discharging unit 5 from the fixing unit 44 (the image forming unit 4).

The sheet discharging unit 5 includes a sheet discharging path 51 and discharge rollers 52. The image-formed sheet S is conveyed to the sheet discharging path 51 from the fixing unit 44, then directed frontward, and finally discharged by the discharge rollers 52 onto a discharge tray 22 formed outside of the main body 2.

In case that another image needs to be formed on another side of the sheet S (double-side printing), the discharge rollers 52 is caused to rotate inversely before the sheet S is completely discharged out of the main body 2. The sheet S is drawn back within the main body 2 and conveyed along a bottom portion of the main body 2 back to the image forming unit 4, as indicated by a thick broken line in FIG. 1.

<Detailed Constructions of Process Cartridge 42 and Drawer 60>

Next, detailed configurations of the process cartridge 42 and the drawer 60 will be described with reference to FIGS. 3 through 5.

The process cartridge 42 is detachably mountable on the drawer 60. As shown in FIG. 3, the drawer 60 has a substantially rectangular parallelepiped shape whose upper surface is opened. The process cartridge 42 is mountable on the drawer 60 from above (from a side opposite to the exposing surface 411A of the LED unit 41). In other words, the LED unit 41 is disposed on the drawer 60 such that the exposing surface 411A is oriented downward, so that the exposing surface 411A cannot be viewed in a path in which the process cartridge 42 is mounted and removed.

Figure 5:
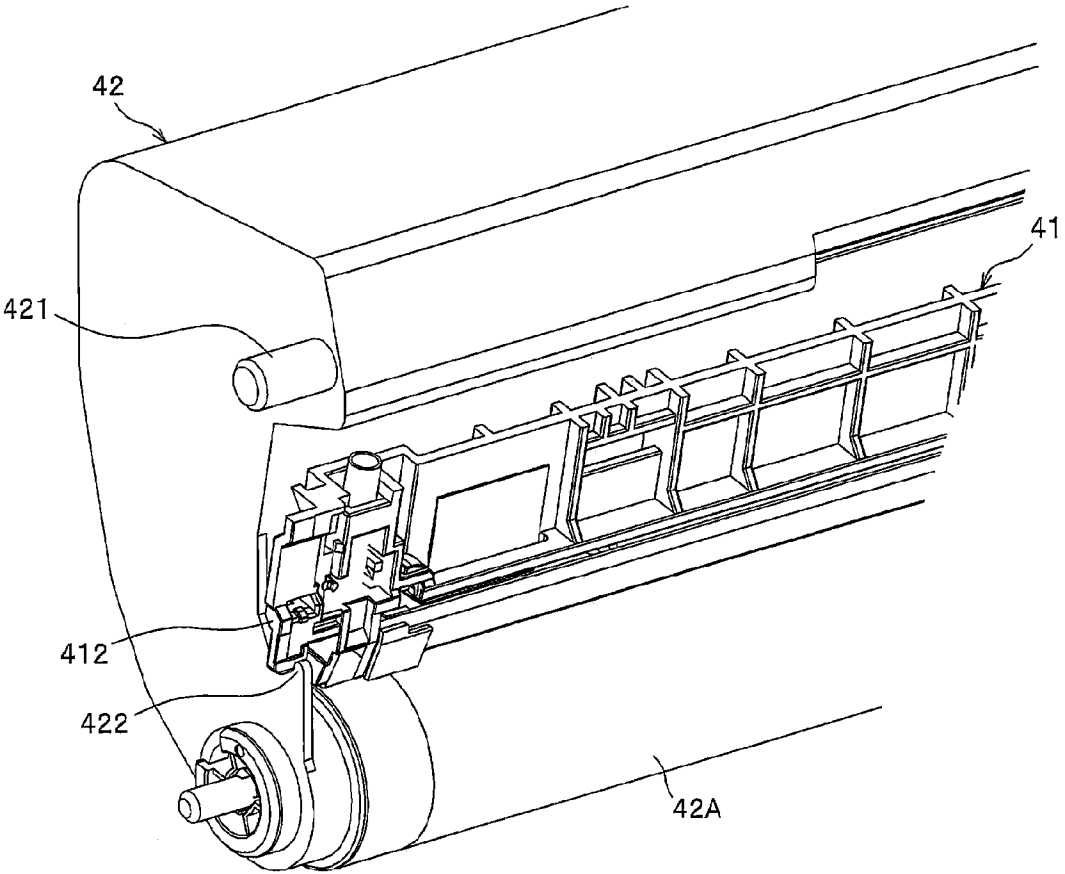
FIG. 5 is a perspective view showing the process cartridge and the LED unit when the process cartridge is mounted in the drawer.

As show in FIGS. 3 and 5, the process cartridge 42 has a pivot shaft 421 at an upper-rear end portion. Specifically, the pivot shaft 421 is disposed rearward of the toner accommodating section B4. In the vertical direction, the pivot shaft 421 is positioned below an upper portion of the developing unit 42B so as not to protrude upward therefrom. The pivot shaft 421 protrudes outward from each of left and right walls of the process cartridge 42.

The drawer 60 includes a pair of side walls (left and right) 61, a front wall and a rear wall (shown without reference numerals in FIG. 3). The front wall and the rear wall connect front and rear end portions of the side walls 61, respectively. The drawer 60 detachably supports the four process cartridges 42 between the pair of side walls 61. The four LED units 41 (more specifically, the base portion 414 of each process cartridge 42) are also supported by the pair of side walls 61.

In FIG. 3, the drawer 60 is illustrated as being completely separated (detached) from the main body 2, but the drawer 60 may be configured not to be detached from the main body 2.

Each side wall 61 is formed with four pairs of a bearing groove 611 and a releasing groove 612. Each bearing groove 611 is adapted to receive the pivot shaft 421 of the each process cartridge 42. Each releasing groove 612 is adapted to receive the rotational shaft A1 of the photosensitive drum 42A so that the process cartridge 42 can move along the releasing groove 612.

Each bearing groove 611 has a substantially U-shape. The bearing groove 611 extends from an upper edge of the corresponding side wall 61 down to a position above the corresponding LED head 411. The bearing groove 611 has a width in the front-to-rear direction that gradually becomes greater as approaching to the upper edge of the side wall 61.

Each bearing groove 611 has a bottom end portion serving as a shaft-supporting portion 611A. The shaft-supporting portion 611A has a substantially semi-circular shape. Each pivot shaft 421 of each process cartridge 42 is inserted from above into the corresponding bearing groove 611, guided along the bearing groove 611, and finally received at the shaft-supporting portion 611A. The shaft-supporting portion 611A thus rotatably supports the pivot shaft 421 of the process cartridge 42.

Each releasing groove 612 is a substantially J-shaped groove, extending from the upper edge of the corresponding side wall 61 downward to a position close to a bottom end portion of the side wall 61 and then curving downward and rearward. Specifically, the releasing groove 612 has a straight portion 612C and an arcuate portion 612A. The straight portion 612C extends substantially vertically with a width greater than a diameter of the rotational shaft A1 of the photosensitive drum 42A. The arcuate portion 612A extends downward and rearward from the straight portion 612C. The arcuate portion 612A is one part of a circle whose center is the shaft-supporting portion 611A. The arcuate portion 612A has a rear end portion 612B whose width is slightly smaller than the diameter of the rotational shaft A1 of the photosensitive drum 42A. The distance between the shaft-supporting portion 611A and the arcuate portion 612A is substantially identical to the distance between the pivot shaft 421 and the rotational shaft A1 of the photosensitive drum 42A.

Figure 4:
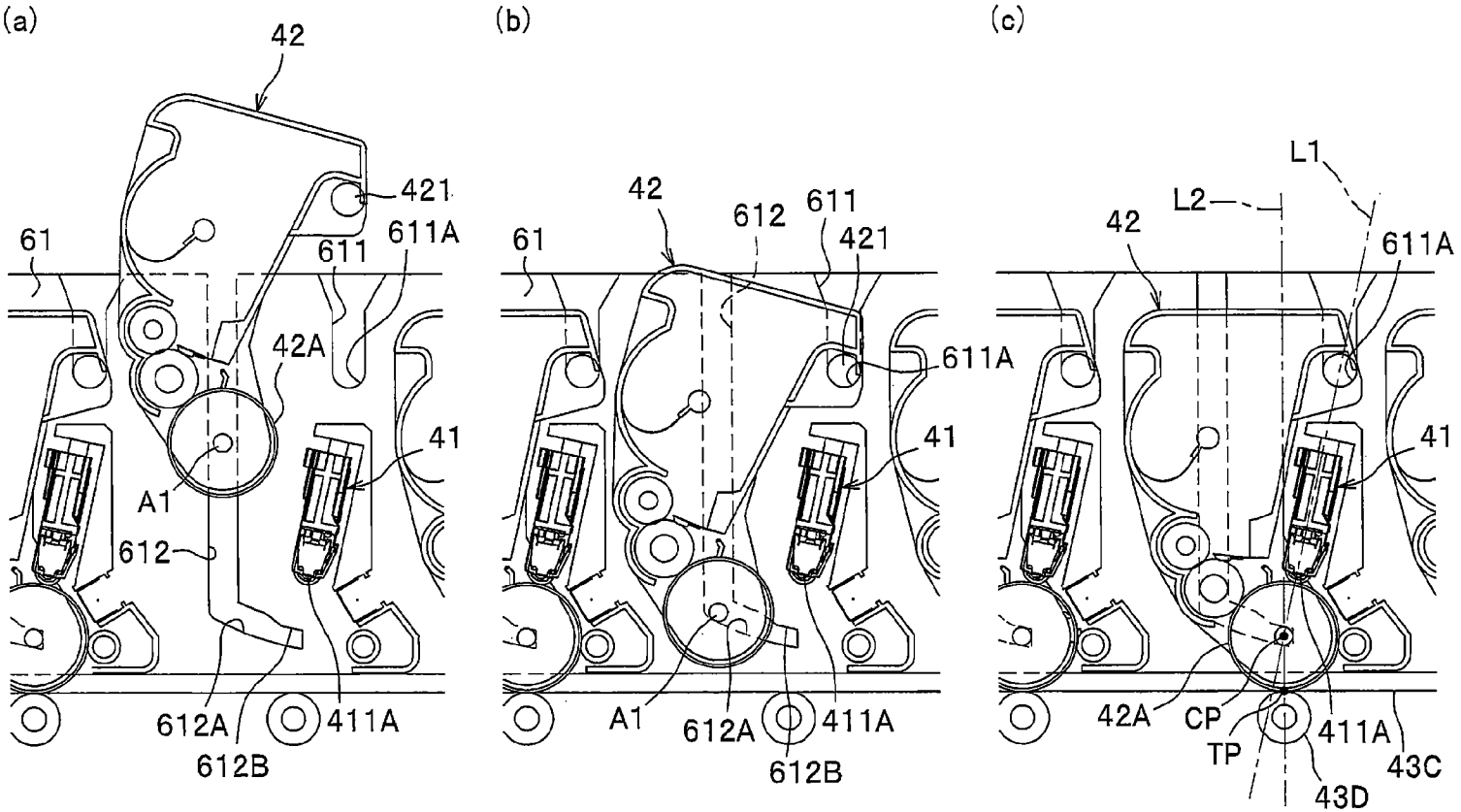
FIG. 4 is an explanatory view showing a process for mounting the photosensitive drum on the drawer.

As shown in FIG. 4(*a*), for mounting the process cartridge 42 on the drawer 60, the rotational shaft A1 of the photosensitive drum 42A is inserted into the corresponding releasing grooves 612, while the pivot shaft 421 of the process cartridge 42 is inserted into the corresponding bearing grooves 611 from above.

Then, as shown in FIG. 4(*b*), when the rotational shaft A1 is brought to contact with the arcuate portion 612A of each bearing groove 611 (more specifically, at a upper end portion of the arcuate portion 612A) in a state where the pivot shaft 421 contacts with the shaft-supporting portion 611A of each bearing groove 611, the rotational shaft A1 is prevented from moving further downward.

A user then pivotally moves the process cartridge 42 about the pivot shaft 421 in the counterclockwise direction. Accordingly, as shown in FIG. 4(*c*), the photosensitive drum 42A is slidingly moved along the arcuate portion 612A to reach the rear end portion 612B, whereby the photosensitive surface of the photosensitive drum 42A can face the exposing surface 411A of the LED head 411. At this time, since the rotational shaft A1 of the photosensitive drum 42A is pinched by the rear end portion 612B having a narrower width than the diameter of the rotational shaft A1 of the photosensitive drum 42A, the photosensitive drum 42A can be positioned relative to the side walls 61.

In other words, the photosensitive drum 42A is movable between an exposing position where the LED head 411 can expose the photosensitive surface of the photosensitive drum 42A (a position where the photosensitive drum 42A is pinched by the rear end portions 612B, FIG. 4(*c*)) and a retracted position where the photosensitive drum 42A is retracted from the LED head 411 (a position where the photosensitive drum 42A is positioned at the upper end portion of the arcuate portion 612A, FIG. 4(*b*)).

Referring to FIG. 4(*c*), an axis of light irradiated from the LED head 411 is shown as a chain line L1, and will be referred to as an axis of light L1. A diametrical center of the photosensitive drum 42A (the rotational shaft A1) is referred to as a center CP, and a position where the toner image is transferred to the sheet S from the photosensitive drum 42A is referred to as a transfer position TP. A chain line L2 represents a line passing through the center CP and the transfer position TP.

Further, as shown in FIG. 4(*c*), the shaft-supporting portion 611A is arranged on the axis of light L1. Since the rotational shaft A1 of the photosensitive drum 42A is moved along the arcuate portion 612A that is one part of a circle whose center is the shaft-supporting portion 611A, the photosensitive drum 42A can move relative to the exposing surface 411A in a substantially parallel manner immediately before the photosensitive surface of the photosensitive drum 42A opposes the exposing surface 411A. Therefore, the interference between the photosensitive drum 42A and the exposing surface 411A can be effectively suppressed.

Here, the transfer position TP means a point where the toner image is transferred to a transfer medium (recording sheets or an intermediate transfer belt). More specifically, the transfer position TP is a point that the photosensitive drum 42A contacts the transfer medium. In the present embodiment, the transfer position TP is a point where the photosensitive drum 42A contacts the sheet S (or the endless belt 43C that conveys the sheet S).

As shown in FIG. 5, each of the left and right walls of the process cartridge 42 is further formed with a pressing protrusion 422. Each pressing protrusion 422 is configured to contact the supporting frame 412 of the corresponding LED unit 41 from downward when the rotational shaft A1 moves to the rear end portion 612B. Thus, the exposing surface 411A of the LED head 411 can stay away from the photosensitive surface of the photosensitive drum 42A by a prescribed distance due to the pressing protrusion 422 at the time of mounting of the photosensitive drum 42A. Thus, the interference between the exposing surface 411A and the photosensitive drum 42A can be further suppressed.

With the above-described construction, the process cartridge 42 can smoothly pivotally move about the pivot shaft 421 that is supported by the shaft-supporting portion 611A, mounting of the process cartridge 42 on the drawer 60 can be stably performed and facilitated.

Another construction for mounting the process cartridge 42 on the drawer 60 from a side opposite to the exposing surface 411A of the LED unit 41 is also conceivable. For example, a construction without providing the pivot shaft 421 and the shaft-supporting portion 61A in which a shaft protruding outwardly from each side wall of a process cartridge is inserted into and moved along an arcuate-shaped guide groove formed on each side wall of a casing of a drawer so that a photosensitive drum is moved to a position beneath an exposing surface of an exposing device. However, under such construction, inserting the shaft of the process cartridge into the corresponding guide grooves in a balanced manner (without causing tilting of the process cartridge in the left-to-right direction) is conceivably difficult, possibly causing the process cartridge to get stuck halfway and prevented from being fully mounted.

In contrast, with the construction of the process cartridge 42 and the drawer 60 according to the present embodiment, the process cartridge 42 can smoothly pivotally move about the shaft-supporting portion 611A without causing any imbalance with respect to the left-to-right direction. Therefore, the process cartridge 42 can be stably and easily mounted on the drawer 60 without getting stuck.

Further, at the time of mounting the process cartridge 42, both left and right guide rollers 412A of the LED unit 41 can be simultaneously brought into contact with the photosensitive drum 42A. Therefore, the guide roller 412A can be prevented from being damaged.

Further, the in the present embodiment, the shaft-supporting portion 611A is positioned on the axis of light L1. This configuration permits the photosensitive drum 42A to move relative to the exposing surface 411A in a substantially parallel manner immediately before the photosensitive surface of the photosensitive drum 42A opposes the exposing surface 411A. Therefore, interference between the photosensitive drum 42A and the exposing surface 411A can be effectively suppressed.

Further, the charger 60A and the cleaning roller 60B each having a relatively longer service life are disposed on the drawer 60 instead of the process cartridge 42. Hence, unnecessary replacement of the charger 60A and the cleaning roller 60B can be prevented, while reduction in weight can be achieved for the process cartridge 42.

Further, the process cartridges 42 and the LED units 41 are mounted on the drawer 60 which is configured to be movable relative to the main body 2. Hence, replacement of the process cartridge 42 can be performed when the drawer 60 is pulled out from the main body 2. Therefore, when the process cartridge 42 is detached from or mounted on the drawer 60 while pivotally moving about the shaft-supporting portion 611A, the process cartridge 42 can be reliably prevented from interfering with the endless belt 43C.

Although the present invention has been described with respect to the specific embodiment thereof, it will be appreciated by one skilled in the art that a variety of changes may be made without departing from the scope of the invention.

Figure 6:
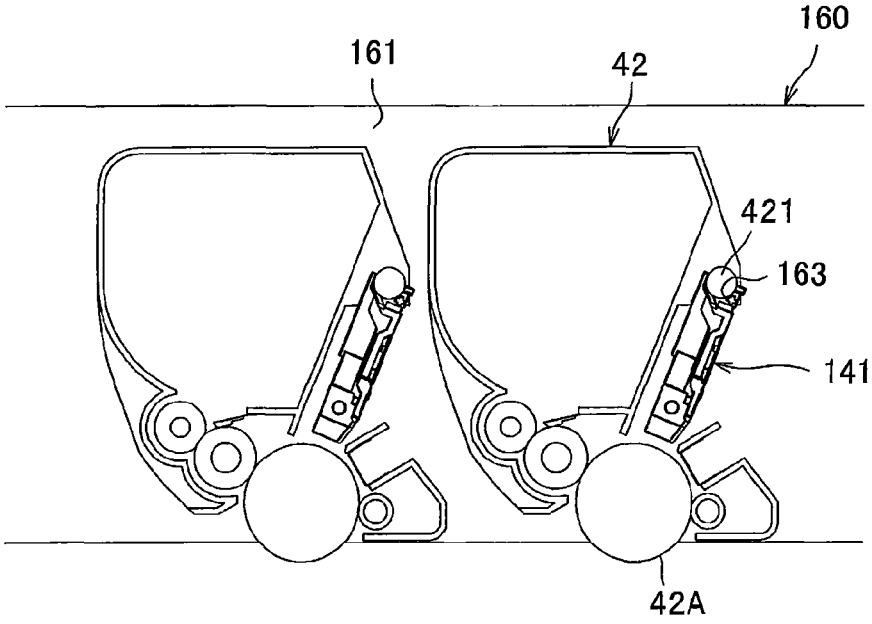
FIG. 6 is view showing the process cartridge according to the embodiment and a drawer according to a first modification of the present embodiment, wherein the process cartridge is mounted in the drawer.
Figure 7:
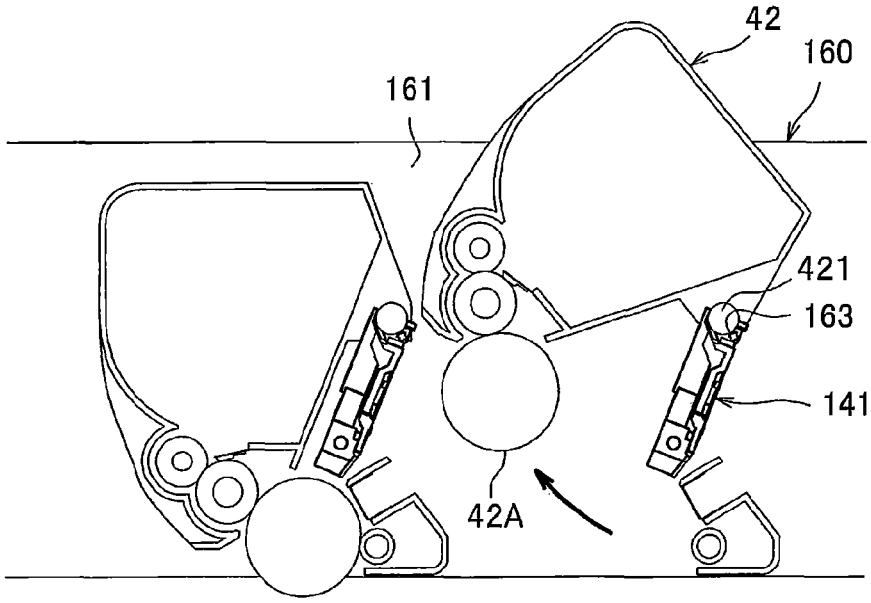
FIG. 7 is a view showing a state where the process cartridge of FIG. 6 is pivotally moved to a retracted position where the process cartridge can be detached from the drawer of FIG. 6.
Figure 8:
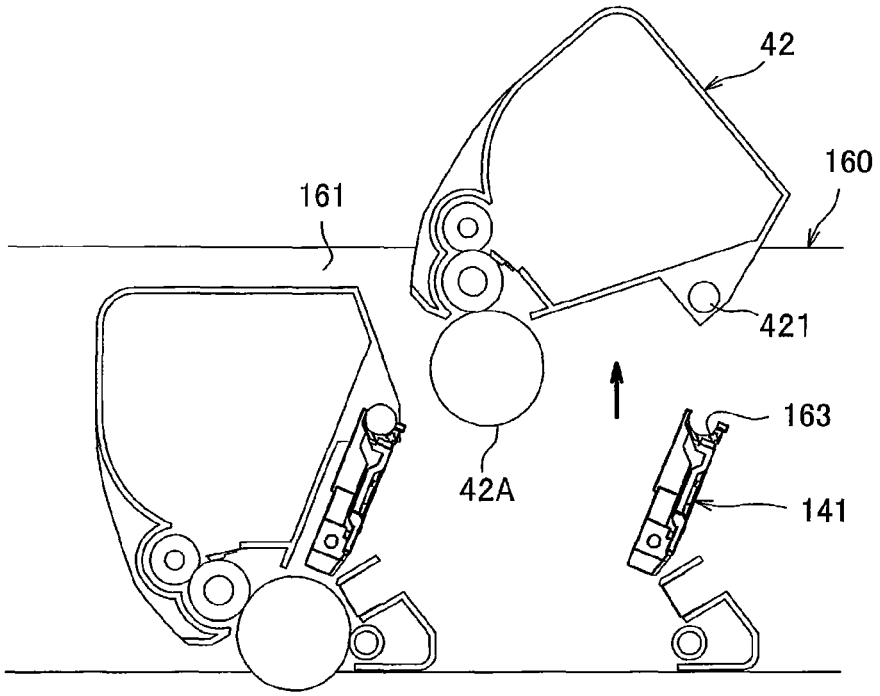
FIG. 8 is a view showing a state where the process cartridge of FIG. 6 is removed from the drawer of FIG. 6.

FIGS. 6 through 8 show the process cartridge 42 and a drawer 160 according to a first modification of the present embodiment. In the following description, like parts and components are designated by the same reference numerals with those of the embodiment to avoid duplicating description.

In the above embodiment, the drawer 60 is formed with the bearing groove 611 for supporting the pivot shaft 421 of the process cartridge 42 and the releasing groove 612 for guiding movement of the rotational shaft A1 of the photosensitive drum 42A. However, in the first modification, only a bearing portion 163 corresponding to the bearing groove 611 is provided on each of four LED units 141.

As shown in FIGS. 6 to 8, when mounting the process cartridge 42, each pivot shaft 421 of the process cartridge 42 is adapted to be supported by the corresponding bearing portion 163. With this construction, the user can realize stable pivotal movement of the process cartridge 42 simply by placing the pivot shaft 421 on the bearing portion 163 without moving the process cartridge 42 downward along the releasing groove 612 as in the above embodiment. As a result, mounting of the process cartridge 42 on the drawer 160 is further facilitated.

Note that the bearing portion 163 is not necessarily formed on each LED unit 141, but may be formed as a member separate from the LED unit 141.

Figure 9:
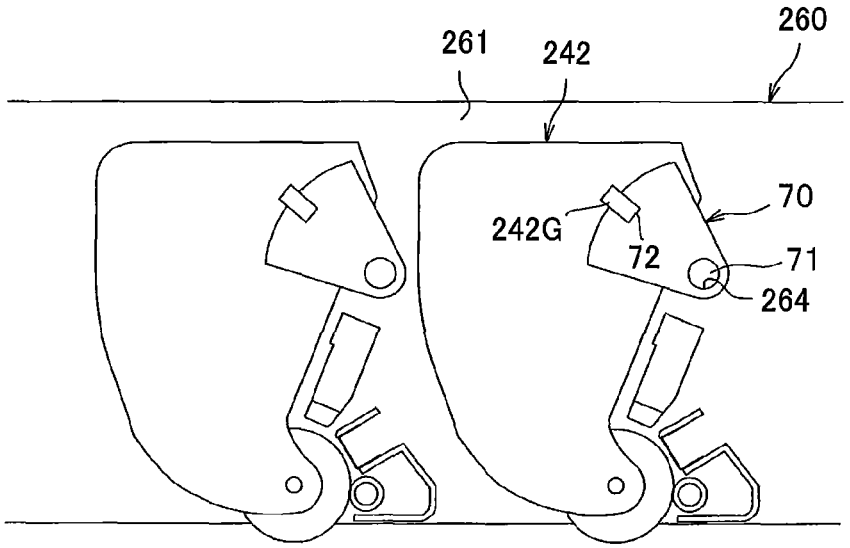
FIG. 9 is a view showing a process cartridge and a drawer according to a second modification of the present embodiment, the drawer being provided with a pivot member to be engaged with the process cartridge, wherein the process cartridge is mounted in the drawer.
Figure 10:
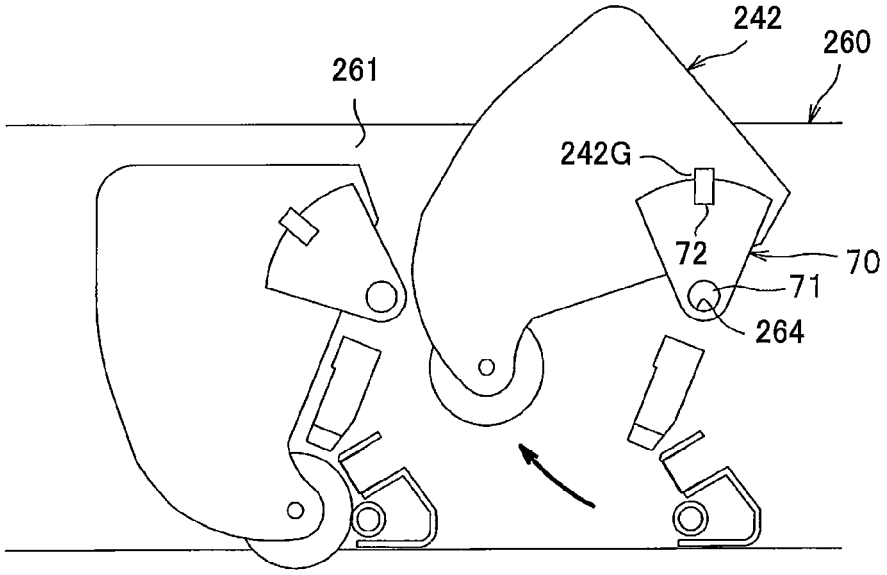
FIG. 10 is a view showing a state where the process cartridge of FIG. 9 is pivotally moved to a retracted position where the process cartridge can be detached from the drawer of FIG. 9.
Figure 11:
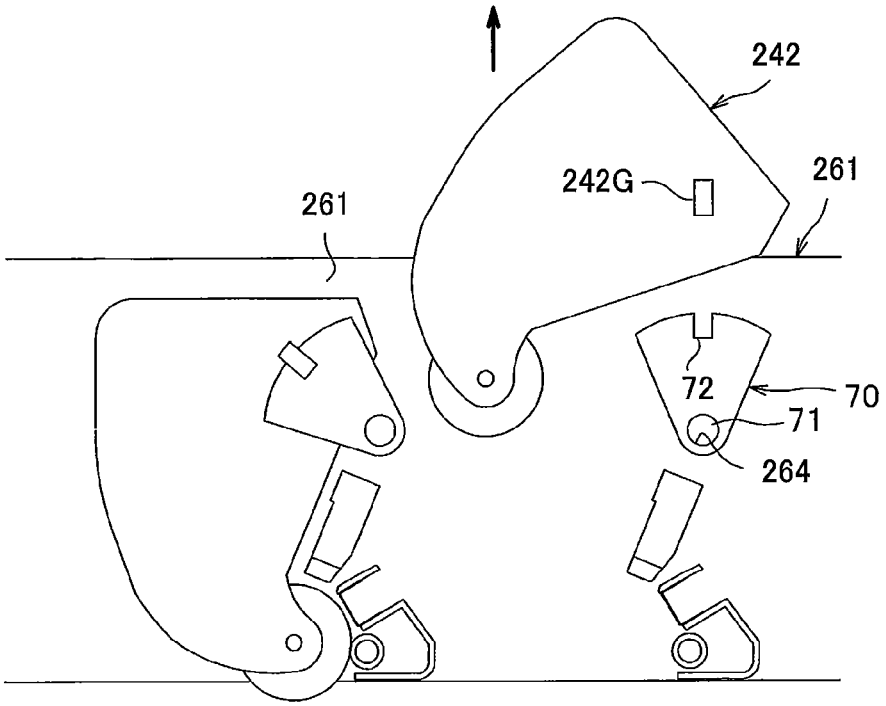
FIG. 11 is a view showing a state where the process cartridge of FIG. 9 is disengaged from the pivot member of the drawer of FIG. 9.

FIGS. 9 through 11 show a process cartridge 242 and a drawer 260 according to a second modification of the embodiment.

In the second modification, each side wall 261 of drawer 260 is formed with four bearing supporting holes 264, each process cartridge 242 is provided with a supported portion 242G, and four pivoting members 70 are provided to pivotably movably support each process cartridge 242 about the corresponding bearing supporting holes 264.

Specifically, each pivoting member 70 has a substantially fan-like shape and is provided with a pivot shaft 71 and a cut-out 72.

Each bearing supporting hole 264 pivotably movably supports the pivot shaft 71 of the corresponding pivoting member 70. The cut-out 72 is adapted to receive a supported portion 242G of the process cartridge 242.

With this construction, the mounted process cartridge 242 is pivotally movable relative to the drawer 260 via the pivoting member 70. The process cartridge 242 is therefore smoothly pivotally movable about the bearing supporting hole 264.

Further, the shaft-supporting portion 611A may be arranged not on the axis of light L1 but between the axis of light L1 and the line L2. In this case as well, the photosensitive drum 42A can move in a substantially parallel manner relative to the exposing surface 411A without causing interference with the exposing surface 411A.

Further, in the embodiment, the side walls 61 of drawer 60 are used for supporting the process cartridges 42. However, the process cartridges 42 may be supported by left and right side walls of the main body 2 while the drawer 60 is dispensed with. In this case, although there arises a problem that the pivotally-moving process cartridge 42 may interfere with the endless belt 43C, such interference can also be suppressed by positioning the shaft-supporting portion 611A between the axis of light L1 and the line L2, as in the embodiment.

Further, instead of the LED unit 41, other light-emitting elements can be employed as the exposing unit. For example, a plurality of electroluminescence elements or fluorescence materials (emitting phosphor) may be arranged, and selectively illuminated based on image data. Alternatively, a plurality of light shutters configured of liquid crystal elements or PLZTs (lead zirconate titanate) and the like may be arranged relative to a single light source. Time periods for opening and closing these light shutters are selectively controlled such that light from the light source can be controlled.

Further, instead of the cleaning roller 60B, a cleaning blade having a plate-shape may be employed as the cleaning member.

Further, the charger 60A and the cleaning roller 60B of the embodiment are arranged on the drawer 60, but the charger 60A and the cleaning roller 60B may be provided on the process cartridge 42, instead of the drawer 60.

Further, the present invention may also be applicable to various image forming apparatuses other than the color printer 1, for example, a multifunction device and a copier.

Further, the sheet S is assumed to represent thick paper, post cards and think sheets of paper as an example of recording sheets. However, OHP sheets may also be employed as the recording sheets.

What is claimed is:

1. An image-forming apparatus comprising:

a process cartridge including a photosensitive drum having a photosensitive surface and a rotational axis;

an exposing unit having a first end, a second end opposing the first end, and an exposing surface formed on the first end and oriented in a predetermined direction;

a supporting member on which the process cartridge is mountable from a side of the second end; and a developing unit configured to supply a developer onto the electrostatic latent image formed on the photosensitive surface of the photosensitive drum to develop the electrostatic latent image into a developer image, the photosensitive drum being configured to transfer the developer image onto a recording medium at a transferring point, wherein the supporting member has a pivotal supporting portion configured to pivotably movably support the process cartridge between an exposing position where the photosensitive surface of the photosensitive drum faces the exposing surface and a retracted position where the photosensitive surface of the photosensitive drum is offset from the exposing surface, the exposing surface being configured to expose the photosensitive surface of the photosensitive drum to form an electrostatic latent image when the process cartridge is positioned at the exposing position, wherein the exposing unit is disposed between the pivotal supporting portion and the photosensitive drum when the process cartridge is positioned at the exposing position, and wherein the pivotal supporting portion is disposed between a first line along a light emitted from the exposing surface and a second line passing through both the rotational axis and the transferring point when the process cartridge is positioned at the exposing position.

2. The image-forming apparatus according to claim 1, wherein the pivotal supporting portion is disposed on the first line.

3. The image-forming apparatus according to claim 1, further comprising a charger provided on the supporting member to charge the photosensitive surface of the photosensitive drum before the exposing unit exposes the photosensitive surface of the photosensitive drum.

4. The image-forming apparatus according to claim 1, further comprising a cleaning member configured to contact the photosensitive surface of the photosensitive drum to remove foreign matters when the process cartridge is positioned at the exposing position.

5. The image-forming apparatus according to claim 1, further comprising:

a casing;

a plurality of process cartridges; and a plurality of exposing units corresponding to the plurality of process cartridges, respectively, wherein the plurality of process cartridges is mountable on the supporting member, and the supporting member is configured to support the plurality of exposing units, and wherein the supporting member is movable relative to the casing.

6. The image-forming apparatus according to claim 1, further comprising a pivoting member configured to be pivotably supported by the pivotal supporting portion and detachably attached to the process cartridge, wherein the pivotal supporting portion is configured to pivotably movably support the process cartridge via the pivoting member.

7. An image-forming apparatus comprising:

a process cartridge including a photosensitive drum having a photosensitive surface and a rotational axis;

an exposing unit having a first end, a second end opposing the first end, and an exposing surface formed on the first end and oriented in a predetermined direction; and a supporting member on which the process cartridge is mountable from a side of the second end, wherein the supporting member has a pivotal supporting portion configured to pivotably movably support the process cartridge between an exposing position where the photosensitive surface of the photosensitive drum faces the exposing surface and a retracted position where the photosensitive surface of the photosensitive drum is offset from the exposing surface, wherein, when the process cartridge is positioned at the exposing position, the exposing unit is disposed between the pivotal supporting portion and the photosensitive drum and the exposing surface of the exposing unit is oriented in the predetermined direction and configured to expose the photosensitive surface of the photosensitive drum to form an electrostatic latent image, and wherein the exposing surface of the exposing unit is kept oriented in the predetermined direction when the process cartridge is positioned at the retracted position.

8. The image-forming apparatus according to claim 7, further comprising a developing unit configured to supply developer onto the electrostatic latent image formed on the photosensitive surface of the photosensitive drum to develop the electrostatic latent image into a developer image, the photosensitive drum being configured to transfer the developer image onto a recording medium at a transferring point, wherein the pivotal supporting portion is disposed between a first line along a light emitted from the exposing surface and a second line passing through both the rotational axis and the transferring point when the process cartridge is positioned at the exposing position.

9. The image-forming apparatus according to claim 8, wherein the pivotal supporting portion is disposed on the first line.

10. The image-forming apparatus according to claim 7, further comprising a charger provided on the supporting member to charge the photosensitive surface of the photosensitive drum before the exposing unit exposes the photosensitive surface of the photosensitive drum.

11. The image-forming apparatus according to claim 7, further comprising a cleaning member configured to contact the photosensitive surface of the photosensitive drum to remove foreign matters when the process cartridge is positioned at the exposing position.

12. The image-forming apparatus according to claim 7, further comprising:

a casing;

a plurality of process cartridges; and a plurality of exposing units corresponding to the plurality of process cartridges, respectively, wherein the plurality of process cartridges are mountable on the supporting member, and the supporting member is configured to support the plurality of exposing units, and wherein the supporting member is movable relative to the casing.

13. The image-forming apparatus according to claim 7, further comprising a pivoting member configured to be pivotably supported by the pivotal supporting portion and detachably attached to the process cartridge, wherein the pivotal supporting portion is configured to pivotably movably support the process cartridge via the pivoting member.

* * * * *